US005184492A

United States Patent [19]

Ushigami

[11] Patent Number: 5,184,492

[45] Date of Patent: Feb. 9, 1993

[54] PLATE STRAIGHTENING MACHINE

[75] Inventor: Yoshihiro Ushigami, Saijo, Japan

[73] Assignee: Sumitomo Heavy Industries, Inc., Tokyo, Japan

[21] Appl. No.: 797,018

[22] Filed: Nov. 25, 1991

[30] Foreign Application Priority Data

Nov. 30, 1990 [JP] Japan ..... 2-128283[U]

[51] Int. Cl.[5] ..... B21D 1/02; B21B 31/10

[52] U.S. Cl. ..... 72/160; 72/164; 72/238

[58] Field of Search ..... 72/160, 164, 165, 238, 72/239, 226

[56] References Cited

U.S. PATENT DOCUMENTS 3,979,939 9/1976 Pazderka ..... 72/239
4,632,655 12/1986 Benkwitz ..... 72/239

FOREIGN PATENT DOCUMENTS 11547 5/1968 Japan ..... 72/165
34623 2/1987 Japan ..... 72/164
149015 6/1988 Japan ..... 72/160
214478 3/1968 U.S.S.R. ..... 72/238
1424891 9/1988 U.S.S.R. ..... 72/239

*Primary Examiner*—Daniel C. Crane
*Attorney, Agent, or Firm*—Nikaido, Marmelstein, Murray & Oram

[57] ABSTRACT

A plate straightening machine includes upper rolls and an upper frame rotatable from an operating position, at which the upper rolls face downward, to a non-operating position, at which the upper rolls face upward. The plate straightening machine further includes a mounting plate detachably attached to the upper frame so that the mounting plate can be moved toward either side of the path, and at least one upper roll replacing stand disposed on either side of the upper frame in the non-operating position so that the upper roll replacing stand is flush with the upper frame for enabling the mounting plate to be moved between two positions on the upper frame and the upper roll replacing stand, respectively.

3 Claims, 3 Drawing Sheets

PLATE STRAIGHTENING MACHINE

BACKGROUND OF THE INVENTION

1. Field of the Invention

The present invention relates to a plate straightening machine for straightening plates, such as thin and thick plates, with rolls.

2. Description of the Related Art

Straightening machines have a stand into which a group of upper work rolls and a group of lower work rolls are built. The upper and lower work rolls are appropriate combinations of various rolls, such as small, intermediate and large work rolls, including back-up rolls. The upper and lower rolls straighten bends in strips.

Because the lower rolls of such a straightening machine are moved up and down by a pressure device, they can be easily replaced with new rolls. However, because the upper rolls are fixed, it is difficult to replace and maintain them. In order to easily replace and maintain the upper rolls, an upper frame over which the upper rolls are installed is rotated upwardly through 180° in a path in which strips are fed (in a path direction) from an operating position, at which the upper rolls face downward, to a non-operating position, at which the upper rolls face upward.

To replace the upper rolls, the upper rolls in the non-operating position are removed and are carried by a crane to a spot where they are replaced with new rolls. The new rolls are carried by the crane onto the upper frame and are then mounted thereon.

However, such a replacing method is troublesome and time-consuming. Since replacement of the upper rolls are carried out above a strip, dust on the upper frame and other components fall onto the strip, thus staining it. In addition, it is dangerous to replace upper rolls because they are carried by a crane.

There is a type of straightening machine in which the replacement of upper rolls is carried out quickly in the following way. The upper rolls are installed on a common mounting plate which is replaced with a new mounting plate. This replacing method, however, has the same problems, for the same reason, as the previous method, e.g., it is troublesome and time-consuming, and a strip may be stained. This method is also dangerous because mounting plates are carried by a crane.

SUMMARY OF THE INVENTION

The present invention has been made to solve the above problems. The object of this invention is to provide a plate straightening machine in which the replacement of upper rolls can be carried out easily, quickly and safely, without staining strips.

To achieve the above object, in accordance with one aspect of the present invention, there is provided a plate straightening machine comprising a structure in which an upper frame having upper rolls is rotated in a path from an operating position, at which the upper rolls face downward, to a non-operating position, at which the upper rolls face upward, wherein the upper rolls are installed on a mounting plate which is detachably attached to the upper frame so that the mounting plate can be moved toward a side of the path, and wherein at least one upper roll replacing stand is disposed on a side of the upper frame in the non-operating position so that the upper roll replacing stand is flush with the upper frame for enabling the mounting plate to be moved between two positions on the upper frame and the upper roll replacing stand, respectively.

The upper roll replacing stand may be provided on either side or both sides of the path.

Old upper rolls are replaced with new rolls in the following manner: the mounting plate, on which old upper rolls in the non-operating position are installed, is removed from the upper frame. It is then moved onto one upper roll replacing stand on either side of the path. New upper rolls are installed over another mounting plate on another upper roll replacing stand. This mounting plate is moved onto and secured to the upper frame.

When the upper roll replacing stand is provided on only one side of the path, the mounting plate is removed from the upper frame and is then moved onto one side of the upper roll replacing stand. New rolls are then installed over another mounting plate on the other side of the upper roll replacing stand. This mounting plate is then moved onto and secured to the upper frame.

Thus, by merely moving the mounting plates, old rolls can be replaced with new rolls easily, quickly and safely. In addition, it is not necessary to use crane or other vehicle to lift up the rolls.

DESCRIPTION OF THE PREFERRED EMBODIMENTS

Figure 1:
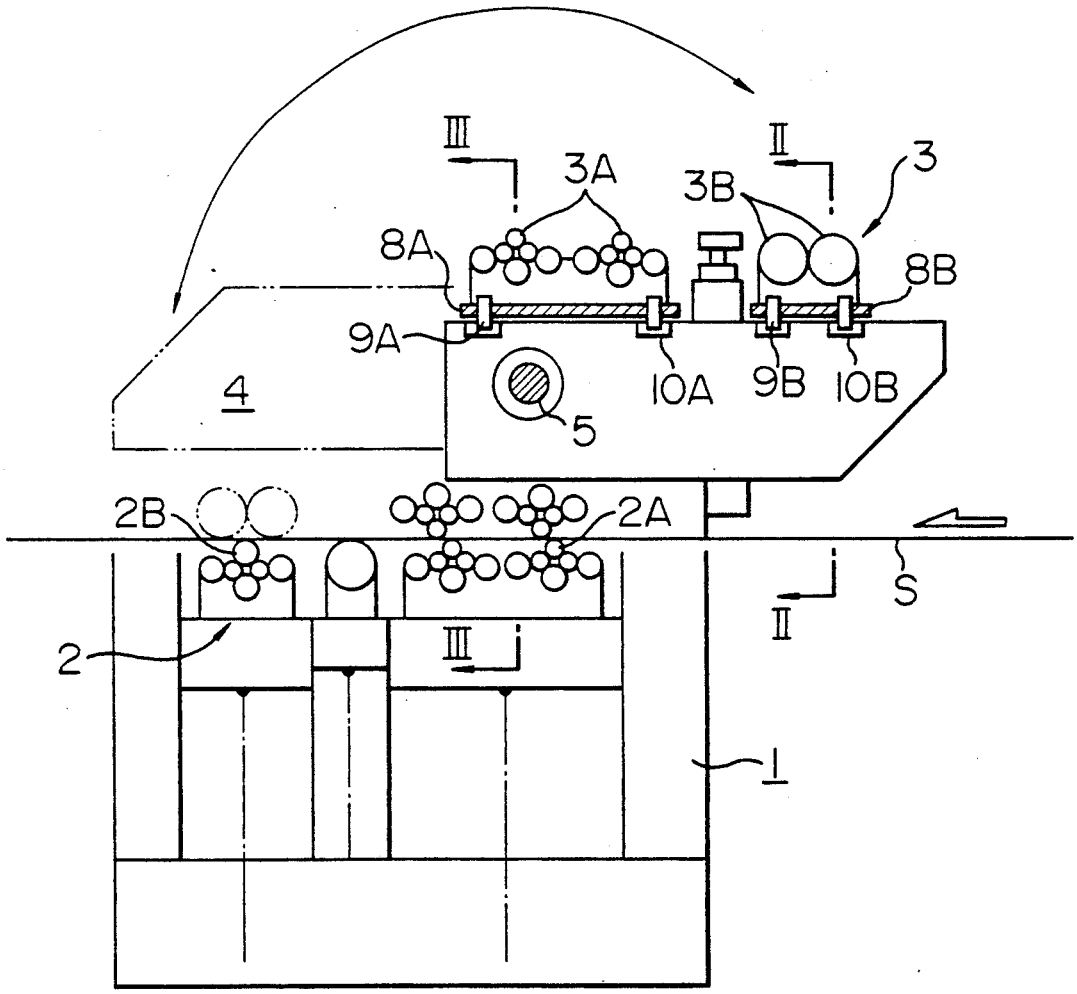
FIG. 1 is a schematic cross-sectional view showing a plate straightening machine in accordance with the present invention.
Figure 2:
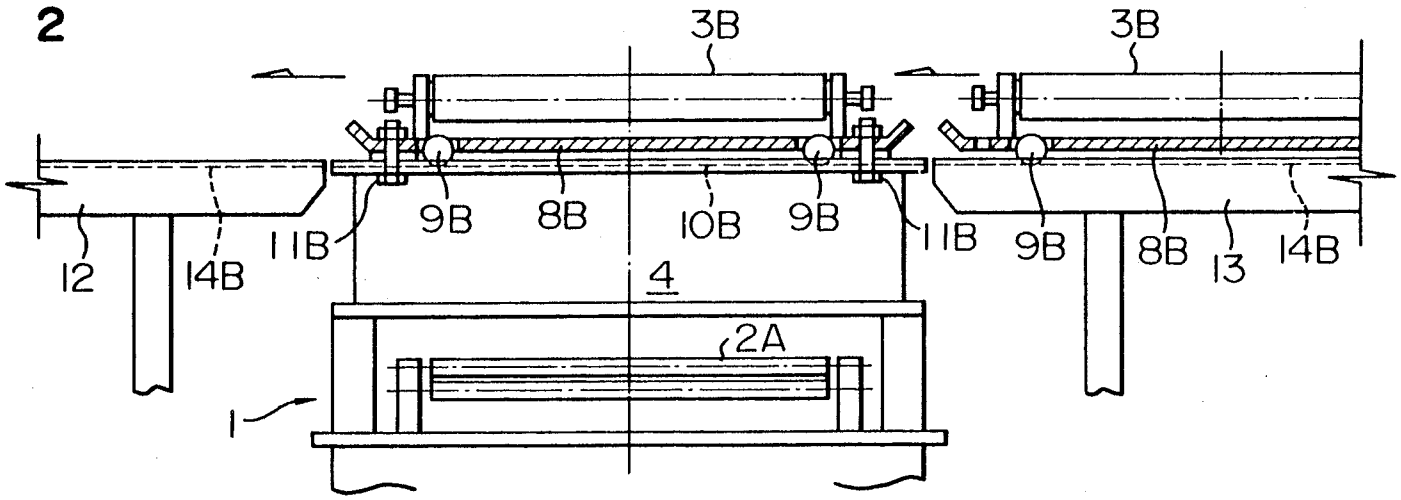
FIG. 2 is a cross-sectional view taken along line II—II of FIG. 1.
Figure 3:
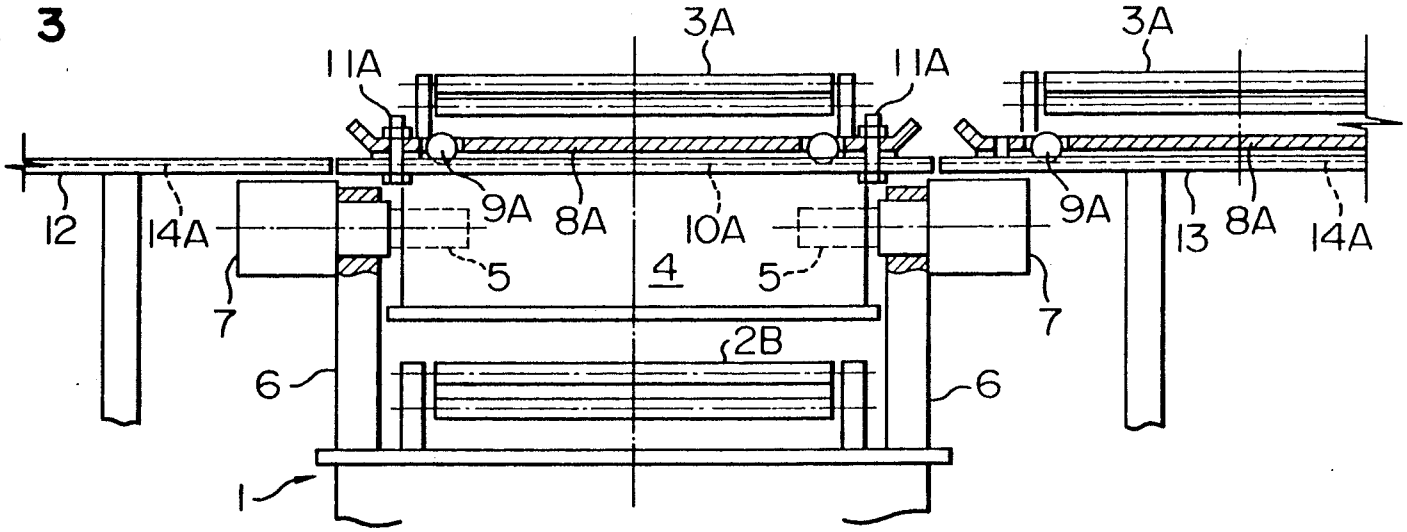
FIG. 3 is a cross-sectional view taken along line III—III of FIG. 1.
Figure 4:
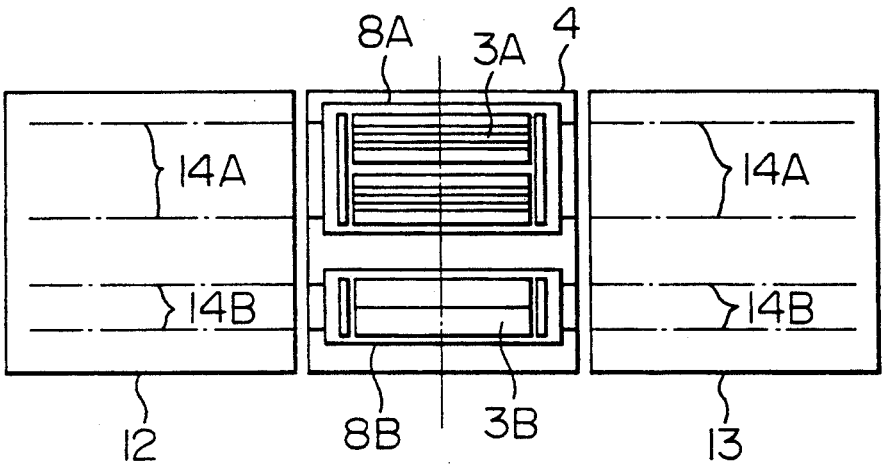
FIG. 4 is a plan view of the straightening machine.

The present invention will be described below on the basis of illustrated embodiments thereof. As shown in FIGS. 1 through 4, a lower group of rolls 2 is built into a stand 1. It is an appropriate combination of work rolls, such as small diameter work rolls 2A and intermediate diameter work rolls 2B, having back-up rolls. An upper group of rolls 3 is composed of work rolls, such as small diameter work rolls 3A and large diameter work rolls 3B. The upper group of rolls 3 is disposed over an upper frame 4 so that it, together with the lower group of rolls 2, can straighten bends in a strip S.

The upper frame 4 is supported by stand frames 6 so as to rotate on a pair of rotary shafts 5 projecting in a crosswise direction to the straightening machine 1. Rotary devices 7 connected to the rotary shafts 5 rotate the upper frame 4 substantially 180° in a path in which strips are fed so that the upper rolls 3 can be arranged in an operating position, at which they face downward, and the upper rolls 3 can be arranged in a non-operating position, at which they face upward.

In a structure as described above, the small diameter rolls 3A and the large diameter rolls 3B are installed on mounting plates 8A and 8B, respectively. The mounting plates 8A and 8B are movably installed on the upper frame 4 in the non-operating position with wheels 9A and 9B running on rails 10A and 10B perpendicular to the path and are arranged to be securely fixed to the upper frame 4 with tightening members 11A and 11B.

The wheels 9A are attached to the four corners of the mounting plate 8A; similarly, the wheels 9B are attached to the four corners of the mounting plate 8B. A pair of rails 10A and another pair of rails 10B, all having either a concave or convex configuration, are disposed on the obverse surface of the upper frame 4 in the non-operating position.

The tightening members 11A and 11B each are composed of a bolt, a nut and a spacer, and are used to firmly affix the mounting plates 8A and 8B to the upper frame 4.

Upper roll replacing stands 12 and 13 are arranged on both sides of the path, near the upper frame 4 in the non-operating position. The obverse surfaces of the upper roll replacing stands 12 and 13 are flush with the obverse surface of the upper frame 4 in the non-operating position. Rails 14A and 14B similar to the rails 10A and 10B of the upper frame 4 are disposed on the upper roll replacing stands 12 and 13, respectively, as if the rails 10A, 10B 14A and 14B form continuous lines.

In the thus-constructed straightening machine of the present invention, old rolls 3 are replaced with new rolls in the following manner:

(1) The rotary devices 7 rotate upwardly the upper frame 4 substantially 180° so that the upper rolls 3 are arranged in the non-operating position, at which they face upward.

(2) The tightening members 11A and 11B are released.

(3) The mounting plate 8A and 8B, to which the small diameter work rolls 3A and the large diameter work rolls 3B are attached, are moved from the upper frame 4 onto the upper roll replacing stand 12.

(4) Other mounting plates 8A and 8B on which new small diameter work rolls 3A and large diameter work rolls 3B are installed are mounted on the upper roll replacing stand 13. Then these mounting plates 8A and 8B with the new rolls are moved onto the upper frame 4.

(5) The tightening members 11A and 11B firmly secured the mounting plates 8A and 8B with the new rolls to the upper frame 4.

This completes the replacement of the old rolls 3 with new rolls. After the upper frame 4 is rotated substantially 180° back to the operation position, the straightening machine becomes ready for operation.

Figure 5:
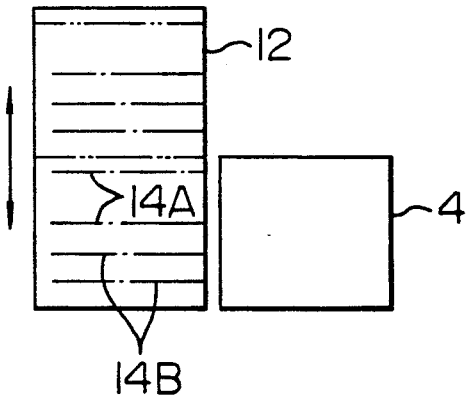
FIG. 5 is a schematic cross-sectional view showing a modification of the straightening machine.

Although the present invention is applied where the upper roll replacing stands 12 and 13 are arranged on both sides of the path, it may also be applied where the upper roll replacing stand 12 is arranged either on the control side or on the operation side. In either case, as shown in FIG. 5, the size of the upper roll replacing stand 12 is so large that two mounting plates mounting old and new upper rolls, respectively, can be held thereon. The upper roll replacing stand 12 is constructed so as to move parallel to the path.

As has been described above, the present invention provides a plate straightening machine having an upper frame which is rotated in the path. The upper rolls are disposed over the mounting plates which are detachably installed on the upper frame so that the can move toward a side of the path. The upper roll replacing stands are arranged on either side or both sides of the upper frame in the non-operating position so that the mounting plates can move onto the replacing stands. The following advantages are obtained from such a straightening machine.

(1) There is no need for rolls to be attached, detached or carried by a crane or other vehicle. Upper rolls can be replaced easily, quickly and safely.

(2) Work on the strip can be reduced to a minimum; consequently, stain on the strip can be reduced greatly.

What is claimed is:

1. A plate straightening machine comprising:

lower rolls;

upper rolls provided in a rotatable upper frame;

wherein an operating position is defined when said upper rolls face downward and said lower rolls face upward so that a cooperating relationship is provided for straightening bends in a work piece, and a non-operating position is defined when said upper frame is rotated along an arcuate path to a position where the upper rolls face upward;

said upper rolls being installed on a mounting plate which is detachably attached to the upper frame so that the mounting plate can be moved toward a side perpendicular to said path when in the non-operating position; and wherein at least one upper roll replacing stand is disposed on a side of the upper frame in the non-operating position so that the upper roll replacing stand is flush with the upper frame for enabling the mounting plate to be moved between a first position on the upper frame and a second position on the upper roll replacing stand.

2. A plate straightening machine according to claim 1, wherein said two upper roll replacing stands are provided perpendicular to the path.

3. A plate straightening machine according to claim 1, wherein said upper roll replacing stand is provided on one side of the path, and has a size which is large enough to hold two mounting plates in a longitudinal direction parallel to the path, said upper roll replacing stand being movable back and forth in the longitudinal direction.

* * * * *